US008851629B2

(12) United States Patent
Shimada

(10) Patent No.: US 8,851,629 B2
(45) Date of Patent: Oct. 7, 2014

(54) IMAGE FORMING DEVICE AND METHOD OF IMAGE FORMING

(75) Inventor: Yoshitaka Shimada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 186 days.

(21) Appl. No.: 13/460,019

(22) Filed: Apr. 30, 2012

(65) Prior Publication Data

US 2012/0287185 A1 Nov. 15, 2012

(30) Foreign Application Priority Data

May 12, 2011 (JP) ..... 2011-107460

(51) Int. Cl.

| | |
|---|---|
| ***B41J 2/15*** | (2006.01) |
| ***B41J 3/00*** | (2006.01) |
| ***B41J 25/308*** | (2006.01) |
| ***B41J 29/38*** | (2006.01) |
| ***B41J 2/015*** | (2006.01) |
| ***B41J 2/165*** | (2006.01) |
| ***B41J 2/21*** | (2006.01) |
| ***B41J 3/54*** | (2006.01) |

(52) U.S. Cl.

CPC ..... *B41J 2/2117* (2013.01); *B41J 3/543* (2013.01)

USPC ..... 347/40; 347/4; 347/8; 347/9; 347/20; 347/32

(58) Field of Classification Search

USPC ..... 347/9, 20, 4, 8, 32, 40

See application file for complete search history.

(56) References Cited

U.S. PATENT DOCUMENTS

| | | | | |
|---|---|---|---|---|
| 7,244,021 | B2 | 7/2007 | Arai | |
| 7,407,277 | B2 * | 8/2008 | Yoneyama | 347/102 |
| 2006/0203024 | A1 * | 9/2006 | Kusunoki | 347/15 |
| 2007/0188547 | A1 | 8/2007 | Kobayashi et al. | |
| 2007/0279470 | A1 | 12/2007 | Arai | |
| 2010/0302299 | A1 | 12/2010 | Kobayashi et al. | |
| 2011/0037800 | A1 | 2/2011 | Tanoue et al. | |

FOREIGN PATENT DOCUMENTS

| | | |
|---|---|---|
| JP | 2001-113691 | 4/2001 |
| JP | 2004-306591 | 11/2004 |
| JP | 2005-254560 | 9/2005 |
| JP | 2007-050555 | 3/2007 |
| JP | 2011-037178 | 2/2011 |
| JP | 2011-110818 | 6/2011 |
| WO | 2005105452 | 11/2005 |

* cited by examiner

*Primary Examiner* — Sarah Al Hashimi
(74) *Attorney, Agent, or Firm* — Workman Nydegger

(57) ABSTRACT

An image forming device includes, the first head which ejects the first ink, the second head which ejects the second ink, a movement mechanism which moves a relative position of the first head and the second head in a predetermined direction, and a control unit which causes an ejection operation in which ink is ejected from nozzles while relatively moving the head and a medium in the movement direction intersecting the predetermined direction, and a transport operation in which the head and the medium are relatively moved in a predetermined direction to be repeated, and adjusts a head interval as an interval of the first head and the second head in a predetermined direction.

8 Claims, 8 Drawing Sheets

IMAGE FORMING DEVICE AND METHOD OF IMAGE FORMING

This application claims priority to Japanese Patent Application No. 2011-107460, filed May 12, 2011 which is expressly incorporated herein by reference.

BACKGROUND

1. Technical Field

The present invention relates to an image forming device and a method of image forming.

2. Related Art

There is a printer which repeats an ejection operation (pass) in which ink is ejected while a head is moving in the movement direction, and a transport operation which moves a medium in the transport direction intersecting the movement direction, among printers as image forming devices. In addition, there is a printer using ink (UV ink) which is cured when being irradiated with UV light. In such a printer, it is preferable to provide an irradiation light source at both ends of the head in the movement direction (for example, refer to JP-A-2005-254560). By doing that, it is possible to immediately cure the UV ink which has landed on a medium.

In addition, there is a case where a main image which is printed on one head and a background image which is printed on another head are overlappingly printed in a printer on which a plurality of heads is aligned in the transport direction of the medium. However, for example, when one head and another head are fixed in a state where there is no gap, the upper image is overlapped immediately after an underlying image is printed between a main image and a background image. In such a case, there is a concern that the upper image is overlapped with the underlying image in a state of being insufficiently cured, and image quality is deteriorated, when an irradiation amount of the UV light which can be radiated to the UV ink on the medium is small in one pass.

In addition, there is a concern that the upper image is overlapped with the underlying image in a state of being insufficiently dried, and the image quality is deteriorated due to a blurry image, or color blending of the image, even when it is an image using ink which is not necessary to be irradiated with the UV light.

SUMMARY

An advantage of some aspects of the invention is to provide an image forming device in which a deterioration of image quality is suppressed.

According to an aspect of the invention, there is provided (E) an image forming device which includes, (A) a first head in which a first nozzle column in which nozzles ejecting first ink are aligned in a predetermined direction is provided, (B) a second head in which a second nozzle column in which nozzles ejecting second ink are aligned in a predetermined direction is provided, and is located on one side of the first head in the predetermined direction, (C) a movement mechanism which moves a relative position of the first head and the second head in the predetermined direction, (D) a control unit which causes repeated execution of an ejection operation in which ink is ejected from the nozzle while causing the head and the medium to relatively move in the movement direction intersecting the predetermined direction, and a transport operation in which the head and the medium are relatively moved in the predetermined direction, in which the control unit adjusts a head interval as an interval of the first head and the second head in the predetermined direction by the movement mechanism when the main image using the first ink and the background image using the second ink are overlappingly formed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
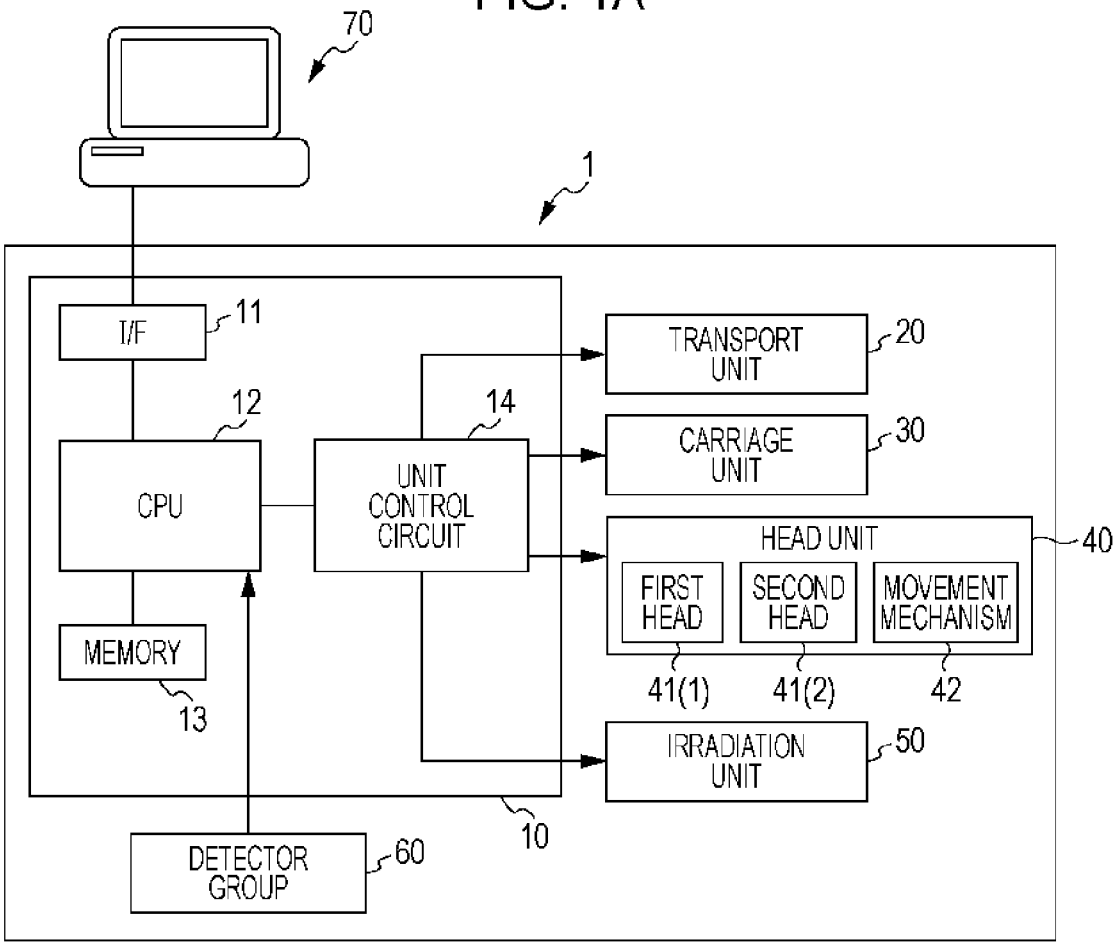
FIG. 1A is a block diagram which shows an overall configuration of a printer.

At least the following will be clarified according to the descriptions of the specification, and accompanying drawings.

That is, (E) an image forming device which includes, (A) a first head in which a first nozzle column in which nozzles ejecting first ink are aligned in a predetermined direction is provided, (B) a second head in which a second nozzle column in which nozzles ejecting second ink are aligned in a predetermined direction is provided, and is located on one side of the first head in the predetermined direction, (C) a movement mechanism which moves a relative position of the first head and the second head in the predetermined direction, (D) a control unit which causes repeated execution of an ejection operation in which ink is ejected from the nozzle while causing the head and the medium to relatively move in the movement direction intersecting the predetermined direction, and a transport operation in which the head and the medium are relatively moved in the predetermined direction, and adjusts a head interval as an interval of the first head and the second head in the predetermined direction by the movement mechanism when the main image using the first ink and the background image using the second ink are overlappingly formed.

According to such an image forming device, a time until overlappingly forming the upper image formed after forming the underlying image which is previously formed between the main image and the background image may be adjusted with respect to the predetermined region of the medium. As a result, for example, a deterioration of an image quality may be suppressed since it is possible to overlap the upper image in a state where the underlying image is sufficiently cured or dried. In addition, it may be possible to prevent an unnecessarily long image forming time.

In the image forming device, the control unit adjusts the head interval so that a non-ejection area in which ink is not ejected between the first nozzle column and the second nozzle column in the predetermined direction is provided, when the main image and the background image are overlappingly formed.

According to such an image forming device, the deterioration of the image quality may be suppressed, since it is possible to overlap the upper image in a state where the underlying image is sufficiently cured or dried.

In the image forming device, the control unit adjusts the head interval so that the length of the non-ejection area in the predetermined direction becomes the length of the integral multiplication of an amount of relative movement of the head and the medium in the predetermined direction in the transport operation.

According to such an image forming device, it may be possible to make a time until the upper image is overlappingly formed after forming the underlying image be constant, and to suppress the deterioration of the image quality without depending on a position in the predetermined direction of the medium.

The image forming device in which the first ink and the second ink are photo-curable ink which cure by being irradiated with light; a light irradiation unit is included which irradiates the photo-curable ink with light, and is arranged by being extended at least in the predetermined direction by stretching to an end portion of one side of the second nozzle column in the predetermined direction from an end portion of the other side of the first nozzle column in the predetermined direction; in the ejection operation, the light irradiation unit and the head, and the medium relatively move in the movement direction; and the control unit adjusts the head interval so that the length of the non-ejection area in the predetermined direction is set to be long when an irradiation amount of light to be radiated to one image during a time until the other image is overlappingly formed on one image after forming the one image in advance between the main image and the background image in a predetermined region of the medium by the light irradiation unit is a second irradiation amount which is larger than a first irradiation amount, compared to a case of the first irradiation amount.

According to such an image forming device, an image forming time may be reduced while overlapping the upper image in a state where the underlying image is sufficiently cured.

The image forming device in which the first ink and the second ink are photo-curable ink which cure by being irradiated with light; the light irradiation unit is included which irradiates the photo-curable ink with light, and is arranged by being extended at least in the predetermined direction by stretching to an end portion of one side of the second nozzle column in the predetermined direction from an end portion of the other side of the first nozzle column in the predetermined direction; in the ejection operation, the light irradiation unit and the head, and the medium relatively move in the movement direction; and when the length of the non-ejection area in the predetermined direction is the second length which is shorter than the first length, compared to a case of the first length, the irradiation intensity of light from the light irradiation unit is strong.

According to such an image forming device, the image forming time may be reduced while overlapping the upper image in a state where the underlying image is sufficiently cured.

In the image forming device, a third nozzle row in which nozzles ejecting the first ink are aligned in the predetermined direction is provided at the second head, and when the background image is not formed on the main image overlappingly, the control unit adjusts the head interval so as not to provide a non-ejection area where ink is not ejected between the first nozzle column and the third nozzle column.

According to such an image forming device, it may be possible to prevent the image forming time becoming long, and to easily control the image forming.

In the image forming device, dot columns which configure the main image, and are formed along the movement direction are formed by the plurality of ejection movements including the transport operation therebetween, and dot columns which configure the background image, and are formed along the movement direction are formed by the plurality of ejection movements including the transport operation therebetween.

According to such an image forming device, it may be possible to similarly cure or dry both a portion of the underlying image which is formed in the previous ejection operation and a portion of the underlying image which is formed in the latter ejection operation. As a result, for example, it may be possible to suppress color unevenness of an image.

In addition, according to another aspect of the invention, there is provided a method of image forming which forms an image on a medium using (E) an image forming device including, (A) a first head in which a first nozzle column in which nozzles ejecting first ink are aligned in a predetermined direction is provided, (B) a second head in which a second nozzle column in which nozzles ejecting second ink are aligned in a predetermined direction is provided, and is located on one side of the first head in the predetermined direction, (C) a movement mechanism which moves a relative position of the first head and the second head in the predetermined direction, and (D) a control unit which causes repeated execution of an ejection operation in which ink is ejected from the nozzle while causing the head and the medium to relatively move in the movement direction intersecting the predetermined direction, and a transport operation in which the head and the medium are relatively moved in the predetermined direction, in which the control unit adjusts a head interval as an interval of the first head and the second head in the predetermined direction by the movement mechanism when the main image using the first ink and the background image using the second ink are overlappingly formed.

According to such an image forming device, it may be possible to adjust a time until overlappingly forming an upper image which is formed after forming an underlying image which is previously formed between a main image and a background image with respect to the predetermined region of the medium. As a result, for example, deterioration of image quality may be suppressed since it is possible to overlap the upper image in a state where the underlying image is sufficiently cured or dried. In addition, it may be possible to prevent an unnecessarily long image forming time.

Printing System

Embodiments of the invention will be described, in which an image forming device is an ink jet printer (hereinafter, referred to as a printer), and a printing system in which a printer and a computer are connected to each other is exemplified.

Figure 1B:
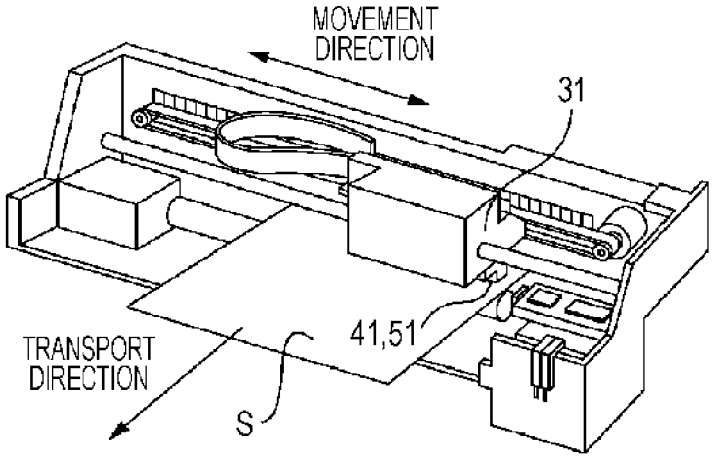
FIG. 1B is a schematically perspective view of the printer.
Figure 2:
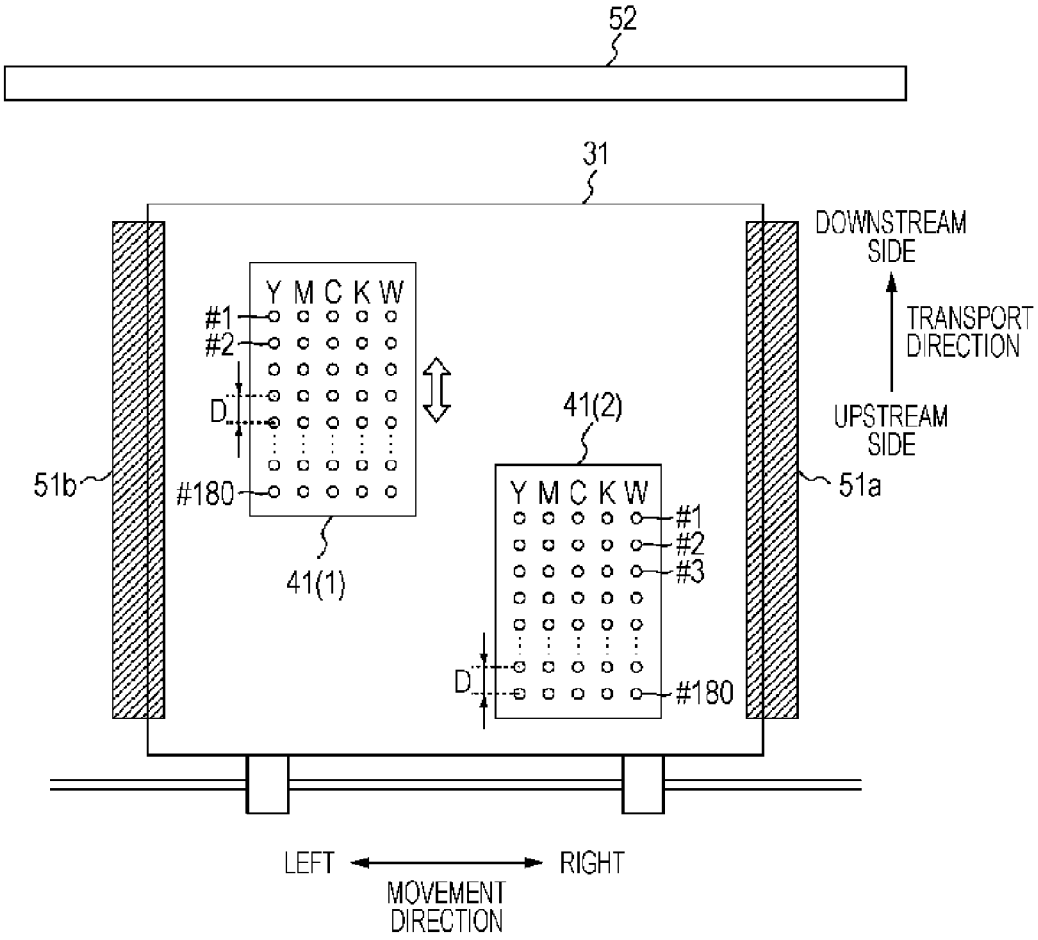
FIG. 2 is a diagram which describes the periphery of a carriage.

FIG. 1A is a block diagram which shows an overall configuration of a printer 1, FIG. 1B is a schematically perspective view of the printer 1, and FIG. 2 is a diagram which describes the periphery of a carriage 31. In addition, FIG. 2 is a diagram which virtually shows an arrangement of the nozzle when seen from the top of a head 41.

The printer 1 according to the embodiment performs printing of an image on a medium S (for example, a sheet, a cloth, and a film), by ejecting UV-curable ink which is cured by an irradiation of UV light. In addition, the UV-curable ink (hereinafter, referred to a UV ink) is ink including UV curing resin, and is cured by a photo-polymerization reaction which occurs in the UV curing resin when being irradiated with the UV light.

A computer 70 is communicably connected to the printer 1, and outputs printing data for printing an image in the printer 1 to the printer 1.

A controller 10 is a control unit for controlling the printer 1. An interface unit 11 is a unit for performing transmission and reception of the data between the computer 70 and the printer 1. A CPU 12 is an arithmetic processing unit for performing the entire control of the printer 1. A memory 13 is a memory for securing an area for storing a program of the CPU 12, a working area, or the like. The CPU 12 controls each unit by a unit control circuit 14. In addition, a detector group 60 monitors a status in the printer 1, and the controller 10 controls each unit on the basis of the detection result.

A transport unit 20 is a unit for sending the medium S at a position to be printed, and transporting the medium S in the transport direction with a predetermined transport amount when performing the printing.

A carriage unit 30 is a unit for moving the head 41 which is mounted to the carriage 31, or the like to the movement direction which intersects the transport direction.

A head unit 40 is a unit for ejecting ink onto the medium S, and includes a first head 41 (1) (corresponding to a first head), a second head 41 (2) (corresponding to a second head), and a movement mechanism 42. As shown in FIG. 2, a plurality of nozzle columns in which nozzles ejecting ink are aligned with a predetermined interval (nozzle pitch D) in the transport direction is formed at the bottom face of each of the heads 41 (1) and 41 (2). For description, a small number (Nos. 1, 2, . . . ) is attached in order from nozzles on the downstream side in the transport direction, among nozzles which belong to each nozzle column.

The printer 1 according to the embodiment is able to eject ink of five colors (YMCK and W), and each head 41 (1) and 41 (2) are formed with a yellow nozzle column Y which ejects yellow ink, a magenta nozzle column M which ejects magenta ink, a cyan nozzle column C which ejects cyan ink, a black nozzle column K which ejects black ink, and a white nozzle column W which ejects white ink.

In addition, the nozzles are communicated with an ink chamber which is filled with ink, and in which an ink ejection method from the nozzle may be a piezoelectric method in which ink is ejected from the nozzle by expanding and contracting the ink chamber by applying a voltage to a driving element (piezoelectric element), or a thermal method in which ink is ejected from the nozzle by bubbles which are generated in the nozzle using a heating element.

Two heads 41 (1) and 41 (2) are aligned in the transport direction, and the second head 41 (2) is located by being deviated from the first head 41 (1) on the upstream side in the transport direction (on one side in the transport direction). A relative position of the first head (1) and the second head 41 (2) are able to move in the transport direction by the movement mechanism 42 (not shown in FIG. 2). Here, the movement mechanism 42 moves the first head 41 (1) in the transport direction with respect to the second head 41 (2).

That is, in the printer 1 according to the embodiment, the interval between the first head 41 (1) and the second head 41 (2) in the transport direction (hereinafter, also referred to as "head interval") is variable, and the controller 10 adjusts the head interval using the movement mechanism 42. Specifically, the head interval is the length in the transport direction from an end portion of the first head 41 (1) on the upstream side in the transport direction to an end portion of the second head 41 (2) on the downstream side in the transport direction. In addition, in order to make the head interval variable, it is possible to make not only the first head 41 (1) movable in the transport direction, but also the second head 41 (2) movable in the transport direction with respect to the first head 41 (1), and both the two heads 41 (1) and 41 (2) are movable in the transport direction.

In such a printer 1, the controller 10 repeats an ejection operation in which ink is ejected from the nozzle while moving the heads 41 (1) and 41 (2), and a provisional irradiation units 51*a* and 51*b* in the movement direction with respect to the medium, and the transport operation which transports the medium in the transport direction with respect to the heads 41 (1) and 41 (2). As a result, a two-dimensional image is printed on the medium S, since dots are formed by the latter ejection operation on a position of the medium S which is different from a position of dots which are formed by the previous ejection. Hereinafter, one ejection operation is referred to as a "pass", as well.

An irradiation unit 50 is a unit for curing the UV ink by irradiating the UV ink landed on the medium S with the UV light, and has a provisional irradiation unit 51 and a main irradiation unit 52. In addition, as a light source of the UV light irradiation, for example, Light Emitting Diode (LED), a metal-halide lamp, a mercury lamp, or the like are exemplified. Further, an irradiation amount of the UV light per unit area by the irradiation unit (irradiation energy ($mJ/cm^2$)) is set by a product of an irradiation intensity of the UV light ($mW/cm^2$)) and an irradiation time (s).

As shown in FIG. 2, the provisional irradiation units 51*a* and 51*b* are provided at both end portions of the carriage 31 in the movement direction, and the provisional irradiation units move in the movement direction together with the head 41 (1) and 41 (2) along with the movement of the carriage 31. In addition, the provisional irradiation units 51*a* and 51*b* are extended in the transport direction similarly to the nozzle columns of the first head 41 (1) and the second head 41 (2). Accordingly, the UV ink which is ejected from the head 41 (1) and 41 (2) during the movement in the movement direction is irradiated with the UV light by the provisional irradiation units 51*a* and 51*b* immediately after landing on the medium S.

The UV ink which is ejected from the heads 41 (1) and 41 (2) is irradiated with the UV light by the first provisional irradiation unit 51*a* which is positioned on the right side in the movement direction, at the time of an outward movement in which the carriage 31 moves to the left in the movement direction. On the contrary, at the time of a homeward movement in which the carriage 31 moves to the right in the movement direction, the UV ink which is ejected from the heads 41 (1) and 41 (2) is irradiated with the UV light by the second provisional irradiation unit 51*b* which is positioned on the left side in the movement direction.

The main irradiation unit 52 is provided on the downstream side of the carriage 31 in the transport direction by being fixed. The length of the main irradiation unit 52 in the movement direction is longer than that of the medium S in the movement direction, and the UV ink on the medium S which passes through under the main irradiation unit 52 is irradiated with the UV light. Accordingly, the UV ink on the medium S is completely cured by the main irradiation unit 52, and an image using the UV ink is completed.

Printing Mode

Figure 3:
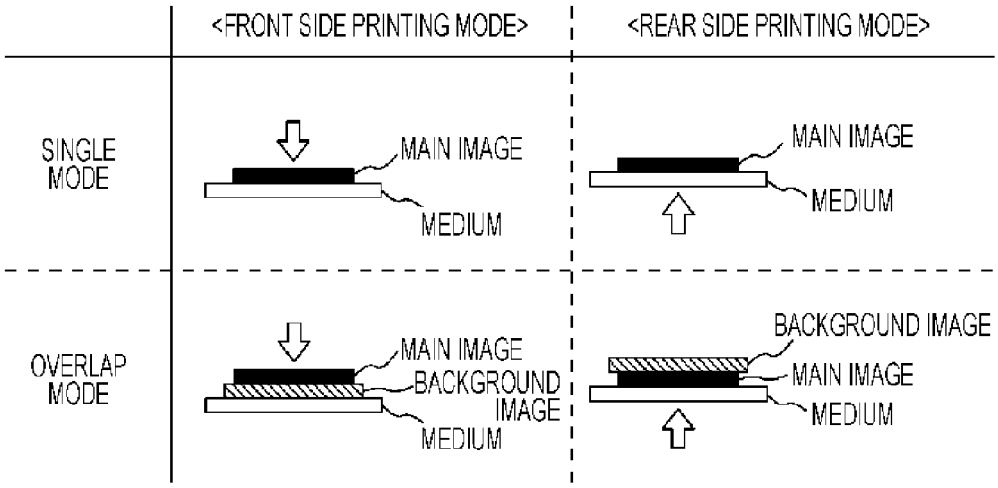
FIG. 3 is a diagram which describes printing modes of the printer.

FIG. 3 is a diagram which describes a printing mode of the printer 1. The printer 1 according to the embodiment includes a single mode in which only the main image (color image or monochrome image) which is printed using ink of four colors (YMCK/first ink) is printed on the medium, and an overlap mode in which the background image which is printed using white ink (W/second ink) is overlappingly printed on the main image. By overlappingly printing the main image and the background image, for example, it is possible to make color development of the main image good when the medium is not white, and to prevent the opposite side of the main image from showing through when the medium is transparent.

In addition, the printer 1 includes a "front side printing mode" in which the main image is printed so as to be seen from a printing surface side, and a "rear side printing mode" in which the main image is printed so as to be seen through the medium. In a case of the overlap mode in which the main image and the background image are overlapped with each other, in the front side printing mode, the background image is firstly printed with respect to a predetermined region on the medium, then the main image is printed on the background image. On the contrary, in the rear side printing mode, the main image is firstly printed with respect to a predetermined region on the medium, then the background image is printed on the main image.

Printing Method: First Embodiment

Printing Method of Single Mode

Figure 4A:
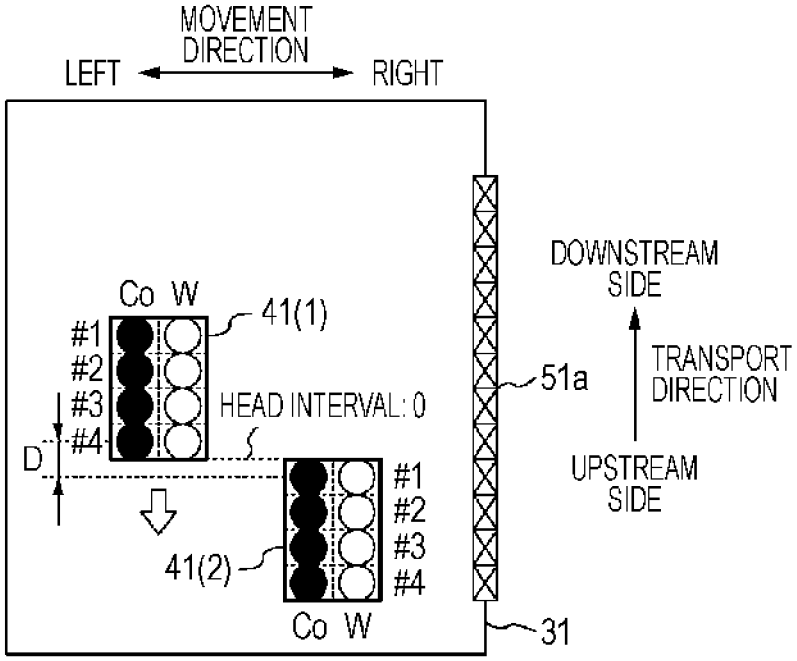
FIG. 4A is a diagram which shows a relative position of a head in a single mode.
Figure 4B:
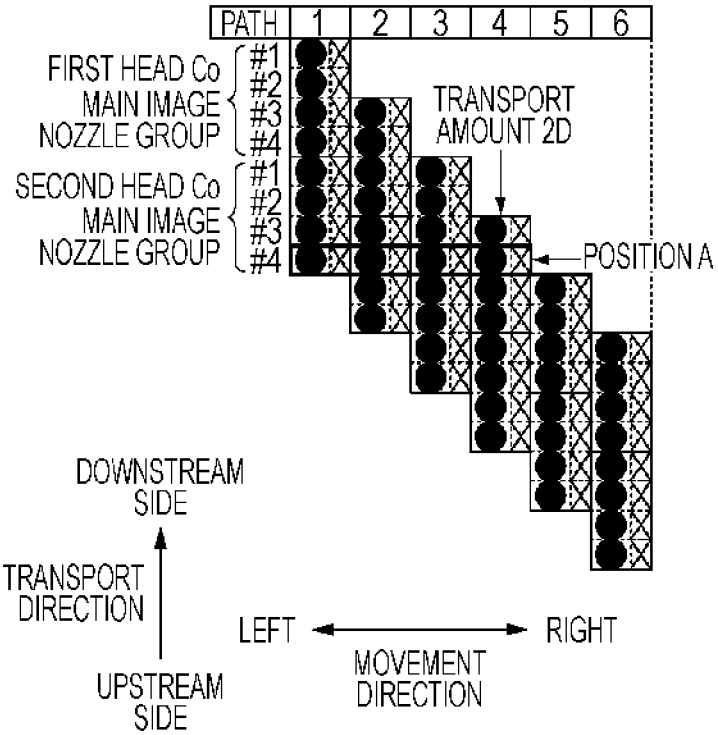
FIG. 4B is a diagram which describes a printing method of the single mode.

FIG. 4A is a diagram which shows a relative position of the first head 41 (1) and the second head 41 (2) in the single mode. FIG. 4B is a diagram which describes a printing method of the single mode. In the figure, the number of nozzles belongs to the one nozzle column of each of head 41 (1) and head 41 (2) is reduced (nos. 1 to 4), and the nozzle columns which eject ink of four colors (YMCK), respectively, are collectively denoted as "color nozzle column Co".

In addition, hereinafter, for ease of description, a printing method in which the head 41 ejects ink only when the carriage 31 moves to the left in the transport direction (outward movement) (a so-called unidirectional printing) will be exemplified. In addition, only the first provisional irradiation unit 51*a* which is provided on the opposite side (right side) to the side where the head 41 moves is made to radiate the UV light, and the second provisional irradiation unit 51*b* (not shown) which is provided on the side where the head 41 moves (left side) does not radiate the UV light.

When the "single mode" in which the background is not overlappingly formed on the main image is executed, the controller 10 (corresponding to control unit) adjusts the head interval between the first head 41 (1) and the second head 41 (2) so that the "non-ejection area" in which ink is not ejected is not provided between the color nozzle column Co of the first head 41 (1) (corresponding to the first nozzle column) and the color nozzle column Co of the second head 41 (2) (corresponding to the third nozzle column) in the transport direction.

Specifically, as shown in FIG. 4A, the controller 10 adjusts the position of the first head 41 (1) with respect to the second head 41 (2) in the transport direction using the movement mechanism 42 so that the interval in the transport direction between the nozzle No. 4 located on the most upstream side of the color nozzle column Co of the first head 41 (1) in the transport direction and nozzle No. 1 located on the most downstream side of the color nozzle column Co the second head 41 (2) in the transport direction becomes the nozzle pitch D.

In addition, as shown in FIG. 2, in the head 41 in practice, there is a predetermined interval between an end portion of the nozzle column in the transport direction and an end portion of the head 41. However, in FIG. 4A, for easy descriptions, the end portion of the nozzle column matches the end portion of the head 41 in the transport direction. Accordingly, in FIG. 4A, the head interval between the first head 41 (1) and the second head 41 (2) becomes 0.

In addition, the controller 10 sets the color nozzle column Co of the first head 41 (1) and the color nozzle column Co of the second head 41 (2) as a "main image nozzle group" which prints the main image, and sets the white nozzle column W of the first head 41 (1) and the white nozzle column W of the second head 41 (2) as a "non-use nozzle group". In addition, when it is a single mode, the nozzles used are the same as each other in both the front side printing mode and the rear side printing mode.

In addition, here, it is set such that the main image is printed by nozzles which are different from each other in pass of four times. That is, it is set such that dot columns configuring the main image which are formed along the movement direction (hereinafter, referred to as a raster line) are printed by nozzles which are different from each other in four times of the pass. In addition, dots are formed on ¼ of a pixel region (unit area defined on the medium according to printing resolution) in one pass, and dots are formed in the entire pixel region aligning in the movement direction in four passes.

For this reason, a medium transport amount in one pass is set to "2D" as two times of the nozzle pitch D. That is, the ejection operation by the main nozzle group and the transport operation in which the medium is transported on the downstream side in the transport direction with the transport amount 2D are alternately repeated. As a result, the printing is performed as shown in FIG. 4B. In addition, the medium is transported on the downstream side in the transport direction with respect to the head 41 in practice, however, in FIG. 4B, the head 41 is shown by being deviated on the upstream side in the transport direction for showing the relative positional relationship of the head 41 in each pass.

As shown in FIG. 4B, for example, the position A on the medium in the transport direction faces the main image nozzle group in the passes 1 to 4, ink of four colors (YMCK) is ejected to the position A, and the ink of four colors landed on the position A is cured by the UV light from the first provisional irradiation unit 51*a*. In this manner, a main image in which a raster line completed by four passes is aligned in the transport direction is printed.

In addition, the head interval may be adjusted such that a position of the color nozzle column Co of the first head 41 (1) at an end portion on the upstream side (for example: nozzle No. 4), and a position of the color nozzle column Co of the second head 41 (2) at an end portion on the downstream side (for example: nozzle No. 1) in the transport direction are overlapped with each other.

Printing Method of Overlap Mode

Figure 5A:
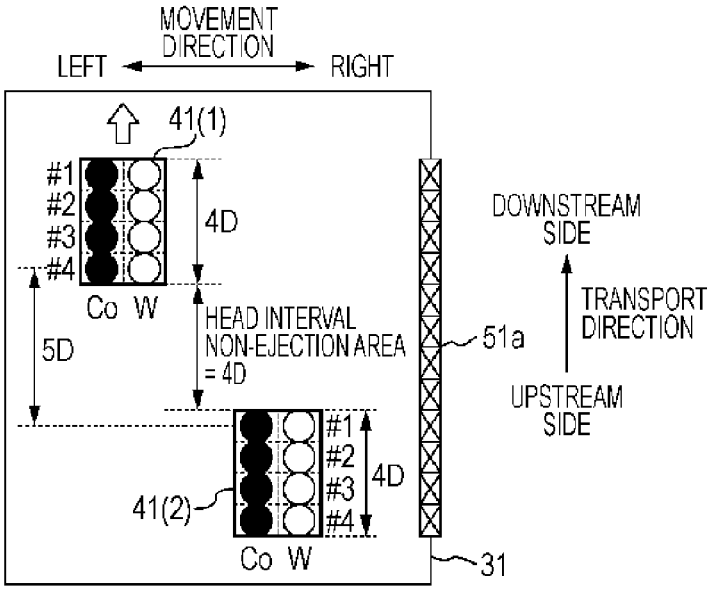
FIG. 5A is a diagram which shows a relative position of the head in a overlap mode.
Figure 5B:
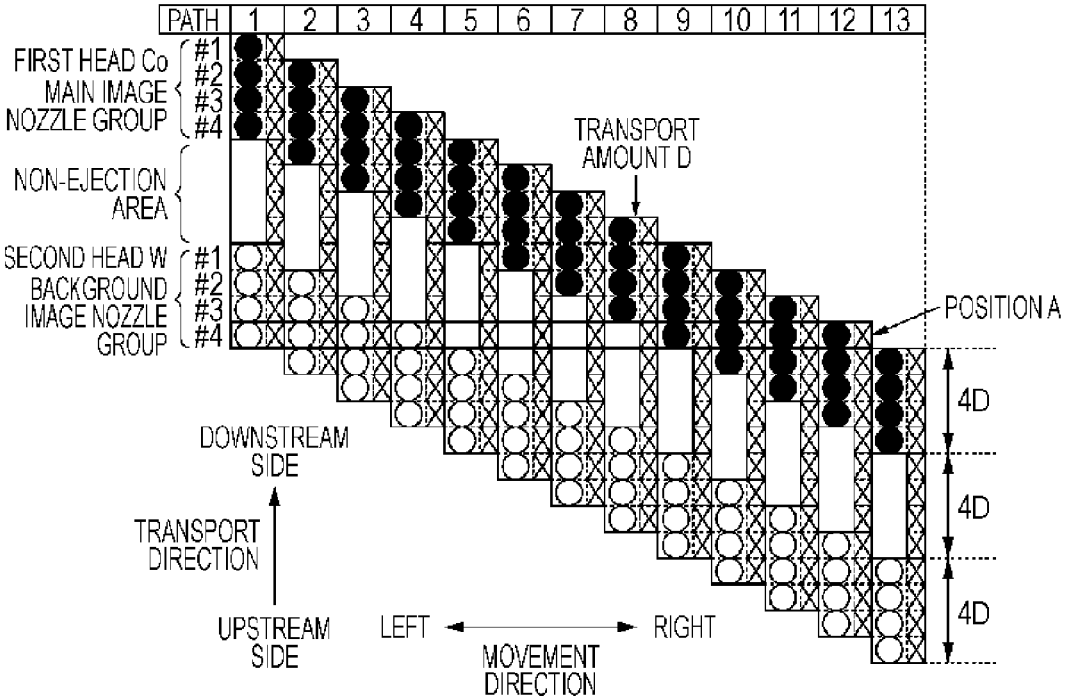
FIG. 5B is a diagram which describes a printing method of the overlap mode.

FIG. 5A is a diagram which shows a relative position between the first head 41 (1) and the second head (2) in the overlap mode, and FIG. 5B is a diagram which describes a printing method of the overlap mode. Similarly to FIGS. 4A and 4B, for ease of description, the head is made to 41 eject ink only in the outward movement, and only the first provisional irradiation unit 51*a* radiates the UV light.

When executing the "overlap mode" in which the main image and the background image are overlapped with each other, the controller 10 adjusts the "head interval" as the interval between the first head 41 (1) and the second head (2) in the transport direction using the movement mechanism 42.

In the first embodiment, as shown in FIG. 5A, the controller 10 adjusts the head interval so that the interval between the end portion on the upstream side of the nozzle columns Co and W belonging to the first head 41 (1) in the transport direction and the interval between the end portion on the downstream side of the nozzle columns Co and W belonging to the second head 41 (2) in the transport direction becomes the length "4D" of the nozzle columns Co and W belonging to each of the heads 41 (1) and 41 (2) in the transport direction.

In this manner, in the first embodiment, when the overlap mode in which the main image and the background image are overlapped with each other is executed, the controller 10 adjusts the head interval so that the first head 41 (1) and the second head 41 (2) are separated from each other in the transport direction, and the "non-ejection area" in which ink is not ejected is provided between the nozzle columns Co and W of the first head 41 (1) and the nozzle columns Co and W of the second head 41 (2) in the transport direction.

In addition, the length of the "non-ejection area" in the transport direction is the length of an interval in the transport direction between the end portion on the upstream side of the nozzle column of the first head 41 (1) and the end portion on the downstream side of the nozzle column of the second head 41 (2), and is set to "4D" in FIG. 5A. Further, in FIG. 5A, for ease of description, the head interval is set to 4D, as well, since the end portion of the nozzle column matches the end portion of the head 41 in the transport direction.

Hereinafter, a printing method of the "front side printing mode" in which the main image is overlapped with the background image will be exemplified (FIG. 5B). In a case of the front side printing mode, the controller 10 sets the color nozzle column Co of the first head 41 (1) on the downstream side in the transport direction (first nozzle column) as the "main image nozzle group", sets the white nozzle column W of the second head 41 (2) on the upstream side in the transport direction (second nozzle group) as the "background image nozzle group", and sets the white nozzle column W of the first head 41 (1) and the color nozzle column Co of the second head 41 (2) as the non-use nozzle group. In addition, in FIG. 5B, the color nozzle column Co of the first head 41 (1) and the white nozzle column W of the second head 41 (2) are denoted by one nozzle column.

In addition, similarly to the above described FIGS. 4A and 4B, the raster lines respectively configuring the main image and the background image are made to be printed by nozzles which are different from each other in pass of four times, and dots are formed in ¼ of the pixel region aligning in the movement direction in each pass. Accordingly, the medium transport amount in one transport operation becomes the nozzle pitch D. That is, the ejection operations by the main image nozzle group and the background nozzle group, and the transport operation in which the medium is transported on the downstream side in the transport direction by the transport amount D are alternately repeated.

As a result, as shown in FIG. 5B, the printing is performed. For example, in the passes 1 to 4, the position A on the medium in the transport direction firstly faces the background image nozzle group (W of the second head 41 (2)), the white ink is ejected to the position A, and the white ink landed on the position A is irradiated with the UV light by the first provisional irradiation unit 51*a*. That is, a portion of the background image (raster lines configuring the background image) is printed on the position A in the passes 1 to 4.

Thereafter, in passes 5 to 8, the position A on the medium faces the non-ejection area. Accordingly, in the passes 5 to 8, the ink is not ejected to the position A, and the white ink landed on the position A is only irradiated with the UV light by the first provisional irradiation unit 51*a*. Accordingly, a portion of the background image which is printed at the position A in the passes 1 to 4 is not overlapped with the main image in the immediately subsequent pass 5, and is able to be sufficiently cured by the UV light from the first provisional irradiation unit 51*a* in the passes 5 to 8.

Thereafter, in passes 9 to 12, the position A on the medium faces the main image nozzle group (Co of the first head 41 (1)), ink of four colors (YMCK) is ejected on the background image of the position A, and the ink of four colors landed on the position A is irradiated with the UV light by the first provisional irradiation unit 51*a*. That is, in the passes 9 to 12, the main image (raster line configuring the main image) is overlappingly printed on the background image of the position A which is sufficiently cured in the passes 5 to 8.

In addition, in the front side printing mode and the rear side printing mode, the relative positional relationship (head interval) between the first head 41 (1) and the second head 41 (2) are is the same as each other, however, the nozzles used in the printing are different from each other. In the rear side printing mode (not shown), the white nozzle column W of the first head 41 (1) is set as the "background image nozzle group", and the color nozzle column Co of the second head 41 (2) is set as the "main image nozzle group", and the other nozzles are set as the "non-use nozzle group".

In this manner, when the main image and the background image are overlappingly printed, the image which is previously printed with respect to a predetermined region of the medium between the main image and the background image (underlying image) is printed using nozzle columns belonging to the second head 41 (2) on the upstream side in the transport direction, and the image which is printed later with respect to a predetermined region of the medium (upper image) is printed using nozzle columns belonging to the first head 41 (1) on the downstream side in the transport direction. By doing that, since a predetermined region of the medium previously faces nozzles printing the underlying image, it is possible to print the main image and the background image overlappingly in different passes from each other in order corresponding to the front side printing mode, or the rear side printing mode.

Printing Method of Comparative Example

Here, it is assumed that the head interval between the first head 41 (1) and the second head 41 (2) is not variable, and as shown in FIG. 4A, the position of the first head 41 (1) and the second head 41 (2) is fixed, in a state where the non-ejection area is not provided between the nozzle column of the first head 41 (1) and the nozzle column of the second head 41 (2).

Figure 6:
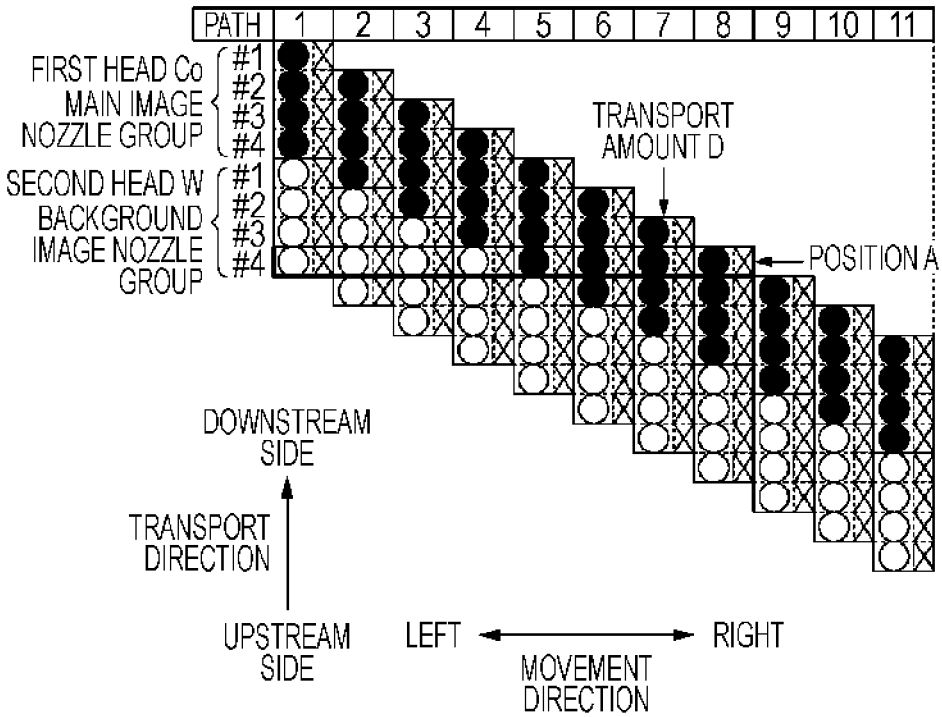
FIG. 6 is a diagram which describes the printing method of the overlap mode when the position of the head is fixed.

FIG. 6 is a diagram which describes a printing method of the overlap mode when the position of the two heads 41 (1) and 41 (2) is fixed, as shown in FIG. 4A. In the figure, the case of the front side printing mode is exemplified, the white nozzle column W of the second head 41 (2) is set as the background image nozzle group, and the color nozzle group Co of the first head 41 (1) is set as the main image nozzle group.

In this case, for example, the position A on the medium in the transport direction faces the background image nozzle group (W of the second head 41 (2)) in the passes 1 to 4, the white ink is ejected to the position A, and the white ink landed on the position A is irradiated with the UV light by the first provisional irradiation unit 51*a*.

Thereafter, the position A on the medium faces the main image nozzle group (Co of the first head 41 (1)) in the passes 5 to 8 subsequent to the pass 4 at which the printing of the background image is completed, the ink of four colors (YMCK) is ejected on the background image of the position A, and the ink of four colors landed on the position A is irradiated with the UV light by the first provisional irradiation unit 51*a*.

In this manner, when the non-ejection area is not provided between the nozzle column of the first head 41 (1) and the nozzle column of the second head 41 (2), the upper image is overlapped with the underlying image thereof in the subsequent pass of the pass in which the printing of the underlying image is completed with respect to a predetermined region of the medium.

The provisional irradiation unit 51*a* which is provided at the carriage 31 irradiates the UV Ink on the medium with the UV light while moving in the movement direction. For this reason, a time during which the provisional irradiation unit 51*a* irradiates the UV Ink on the medium with the UV light in one pass is short, and an irradiation amount of the UV light (irradiation energy) which can be radiated to the UV ink on the medium by the provisional irradiation unit 51*a* in one pass is small. Accordingly, as in the printing method shown in FIG. 6, there is a case where the upper image is overlapped with the underlying image in a state of not being sufficiently cured, when the upper image is overlapped with the underlying image in a pass subsequent to a pass at which the printing of the underlying image is completed. Specifically, when the underlying image is printed in a plurality of passes, a portion of the underlying image printed in the last pass is overlapped with the upper image in a state where the curing degree is low, since it is irradiated with the UV light by the provisional irradiation unit 51*a* only in the final pass.

When the underlying image is overlapped with the upper image in a state of not being sufficiently cured, for example, peeling of the image, aggregation or bleeding of ink, or the like. Alternatively, there is a problem in that the upper image is buried in the underlying image, accordingly, it is difficult to print two images overlappingly. In addition, when the underlying image is printed in a plurality of passes, the number of the passes which is irradiated with the UV light by the provisional irradiation unit 51*a* is different between a portion of the underlying image which is printed in the previous pass and a portion of the underlying image which is printed in the latter pass, accordingly, the upper image is overlapped in a state where the curing degree is different. As a result, color unevenness occurs in the image.

In addition, ⅓ of the nozzle group on the upstream side in the transport direction among the nozzle columns in which the nozzle column of the first head 41 (1) and the nozzle column of the second head 41 (2) are aligned are set as the nozzle group printing the underlying image, ⅓ of the nozzle group at the center in the transport direction are set as the non-use nozzle group, and ⅓ on the downstream side in the transport direction are set as the nozzle group printing the upper image. By doing that, since a predetermined region of the medium is able to face the non-use nozzle group after facing the nozzle group printing the underlying image, it is possible to sufficiently cure the underlying image on the predetermined region of the medium using the UV light radiated from the provisional irradiation unit 51*a* in the mean time. However, the number of nozzles for printing the image is reduced, and the printing time is increased to the extent that a portion of the nozzle groups of the first head 41 (1) and the second head 41 (2) is set as the non-use nozzle group.

On the contrary, as shown in FIG. 5A, it is assumed that the positions of the first head 41 (1) and the second head 41 (2) are fixed in a state where the non-ejection area is provided therebetween. In this case, when the single mode in which only the main image is printed is to be executed by using the two heads 41 (1) and 41 (2), the printing time is lengthened to the extent of the time during which the medium faces the non-ejection area. In addition, since the printing is performed using nozzles which are not aligned in the transport direction in every predetermined interval, the control of the printing becomes complicated. Further, when only one of the two heads 41 (1) and 41 (2) is used in order to make the control easy, the number of nozzles for printing an image is reduced, accordingly, the printing time is further lengthened.

Conclusion

Therefore, in the printer 1 according to the embodiment, the relative position of the first head 41 (1) and the second head 41 (2) can be moved in the transport direction using the movement mechanism 42, and the head interval as the interval between the first head 41 (1) and the second head 41 (2) in the transport direction is set to be variable. In addition, in the overlap mode in which the main image and the background image are overlappingly formed, the controller 10 is assumed to adjust the head interval between the first head 41 (1) and the second head 41 (2). By doing that, it is possible to set the time until the upper image is overlappingly formed after forming the underlying image between the main image and the background image to be adjustable with respect to the predetermined region of the medium.

Further, in a case of the overlap mode, the controller 10 adjusts the head interval so that the first head 41 (1) is separated from the second head 41 (2) in the transport direction, and the "non-ejection area" in which ink is not ejected is provided (FIG. 5A) between the nozzle column of the first head 41 (1) and the nozzle column of the second head 41 (2) in the transport direction.

In addition, it is assumed that the provisional irradiation unit 51*a* and 51*b* (light irradiation unit) are extended at least in the transport direction by being stretched from the end portion on the downstream side of the nozzle column of the first head 41 (1) in the transport direction to the end portion on the upstream side of the nozzle column of the second head 41 (2) in the transport direction. That is, it is set such that the provisional irradiation unit 51*a* and 51*b* are present at a position equal to the position of the non-ejection area in the transport direction, and the provisional irradiation unit 51*a* and 51*b* are able to irradiate the underlying image with the UV light while the underlying image is facing the non-ejection area.

By doing that, as shown in FIG. 5B, a predetermined region of the medium faces the non-ejection area (between the first head 41 (1) and the second head 41 (2)), not the nozzle group which prints the upper image in the subsequent pass after the underlying image is printed in a predetermined region of the medium. For this reason, it is possible to lengthen the time until the upper image is overlappingly formed after forming the underlying image with respect to a predetermined region of the medium, to overlap the upper image in a state where the underlying image on the predetermined region of the medium is sufficiently cured, and to suppress a deterioration of the image quality.

In addition, it is possible to overlap the upper image in a state where the underlying image is sufficiently cured, without setting a portion of the nozzles of the first head 41 (1) and the second head 41 (2) as non-use nozzles, that is, without reducing the number of nozzles printing an image. Accordingly, it is possible to prevent the printing time from being lengthened.

In addition, as shown in FIG. 5A, the controller 10 adjusts the head interval so that the length "4D" of the non-ejection area in the transport direction becomes the length of "four times" as integral multiplication of the medium transport amount "D" in the transport operation.

It is assumed that the length of the non-ejection area in the transport direction (4D) is, for example, the medium transport amount of 3D, not the integral multiplication of the medium transport amount (D). In this case, there are present a medium region in which the number of passes facing the non-ejection area is two passes, and a medium region in which the number of passes facing the non-ejection area is one pass, accordingly, variation occurs in time of irradiating the underlying image with the UV light. In that case, a region in which curing of the underlying image is insufficient is present, or the color unevenness due to the difference in curing degree of the underlying image occurs.

Therefore, the length of the non-ejection area in the transport direction (4D) is set to the integral multiplication of the medium transport amount (D). By doing that, it is possible to make the number of passes in which the medium faces the non-ejection area, that is, the time until the upper image is overlappingly printed after printing the underlying image in a predetermined region of the medium constant, and to make the time of irradiating the underlying image with the UV light constant. Accordingly, it is possible to sufficiently cure the underlying image in the entire region, and to suppress the deterioration of image quality.

In addition, similarly, the length of the main image nozzle group in the transport direction (for example, the length 4D of Co of the first head 41 (1) in FIG. 5), and the length of background image nozzle group in the transport direction (for example, the length 4D of W of the second head 41 (2)) may be set as the length of the integral multiplication of the medium transport amount (D) in one transport operation. By doing that, it is possible to suppress the color unevenness of the image, and to easily control the printing, since it is possible to print the raster line configuring the main image and the raster line configuring the background image with a constant number of nozzles (number of passes), respectively.

In addition, when it is a single mode in which the main image and the background image are not overlappingly formed, the controller 10 adjusts the head interval so as not to provide the non-ejection region between the nozzle column of the first head 41 (1) and the nozzle column of the second head 41 (2) in the transport direction (FIG. 4A).

By doing that, it is possible to make a predetermined region of the medium (main image) face the first head 41 (1) on the downstream side without facing the non-ejection area, after the second head 41 (2) on the upstream side prints the main image in a predetermined region of the medium. Accordingly, it is possible to remove passes only for irradiating the main image with the UV light by the provisional irradiation units 51*a* and 51*b*, and to prevent the printing time from being lengthened. In the single mode, it is not a problem even when there is no pass in which the medium faces the non-ejection area, since only the main image is printed on the medium. In addition, since it is possible to make an interval of the nozzles printing the main image constant in the transport direction, it is easy to control the printing even when two heads 41 (1) and (2) are used. Further, since it is possible to use the two heads 41 (1) and 41 (2) without making the printing control complicated, the printing time can be reduced compared to a case where only one head 41 is used.

In addition, when the main image and the background image are overlapped with each other, the raster line configuring the main image and the raster line configuring the background image are respectively formed by a plurality of passes (ejection operation) including the transport operation therebetween. In this case, since the number of passes to which the UV light is radiated is different between a portion of the underlying image printed in the previous pass and a portion of the underlying image printed in the latter pass, the color unevenness due to the difference in curing degree easily occurs. However, according to the embodiment, since the medium faces the non-ejection area after printing the underlying image, similarly to a portion of the underlying image which is printed in the previous pass, even a portion of the underlying image which is printed in the latter pass can be sufficiently cured by the provisional irradiation units 51*a* and 51*b*. For this reason, it is possible to suppress the color unevenness due to the difference in curing degree between the portion of the underlying image printed in the previous pass and the portion of the underlying image printed in the latter pass.

In addition, when the raster line configuring each image is printed in a plurality of passes, according to the embodiment, it is more effective to provide the non-ejection region between the nozzle column of the first head 41 (1) and the nozzle column of the second head 41 (2). Further, since the raster line configuring each image is printed in a plurality of different nozzles, it is possible to suppress the deterioration of the image quality due to defective nozzles.

In addition, hitherto, the unidirectional printing has been exemplified for easy descriptions, however, it is not limited to this. It is possible to execute a printing method in which ink is ejected from the head 41 (a so-called bidirectional printing) even when the head 41 moves to the left and right in the movement direction.

In addition, it is possible to set such that the two provisional irradiation units 51*a* and 51*b* radiate the UV light at all times, regardless of the direction in which the head 41 moves. By doing that, the UV ink ejected from the head 41 in a pass is not only irradiated with the UV light b the provisional irradiation unit 51 which is provided on the opposite side to the side to where the head 41 moves, but also irradiated with the UV light by the provisional irradiation unit 51 which is provided on the side to where the head 41 moves before the head 41 newly ejects the UV ink in the subsequent pass. For the reason, it is possible to increase the irradiation amount of the UV light radiated to the underlying image, and to overlap the upper image in a state where the underlying image is further cured. Conversely, it is possible to make the length of the non-ejection area short, and to make the printing time short by radiating the UV light by the two provisional irradiation units 51*a* and 51*b*.

In addition, in FIG. 5A, the position of the end portion on the downstream side of the first head 41 (1) is the same as the position of the end portion on the downstream side of the provisional irradiation unit 51*a*, however, it is not limited to this. For example, the provisional irradiation unit 51*a* may be further extended to the downstream side of the nozzle column of the first head (1) in the transport direction. In this case, since a portion of the upper image faces the provisional irradiation unit 51*a* which is extended to the downstream side in the transport direction after completing the printing of a predetermined portion of the upper image, it is possible to sufficiently cure the portion on the upper image. However, in the printer 1 (FIG. 2) according to the embodiment, it is possible to sufficiently cure the upper image even though the provisional irradiation unit 51*a* is not extended to the downstream side in the transport direction, since the main irradiation unit 52 is provided on the downstream side of the carriage 31 in the transport direction. In addition, it may be a printer 1 not including the main irradiation unit 52.

In addition, hitherto, dots are formed on ¼ of the pixel region aligning in the movement direction in one pass, and the dots are formed in the entire pixel region aligning in the movement direction in four times of the pass, however, it is not limited to this. For example, the same color dots may be overlappingly printed in one pixel region. That is, dots may be formed in the entire pixel region aligning in the movement direction in each pass, and four of the same color dots may be formed in each pixel region in pass of four times. By doing that, it is possible improve filling in of the medium by the UV ink, and to increase the density of the image.

In addition, it may be a printing method in which the raster lines which respectively configure the main image and the background image are completed by the pass of two times, not being limited to the pass of four times. As shown in FIG. 5A, in this case, the medium transport amount becomes 2D, when the number of nozzles belonging to one nozzle column if four.

Printing Method: Second Embodiment

Figure 7A:
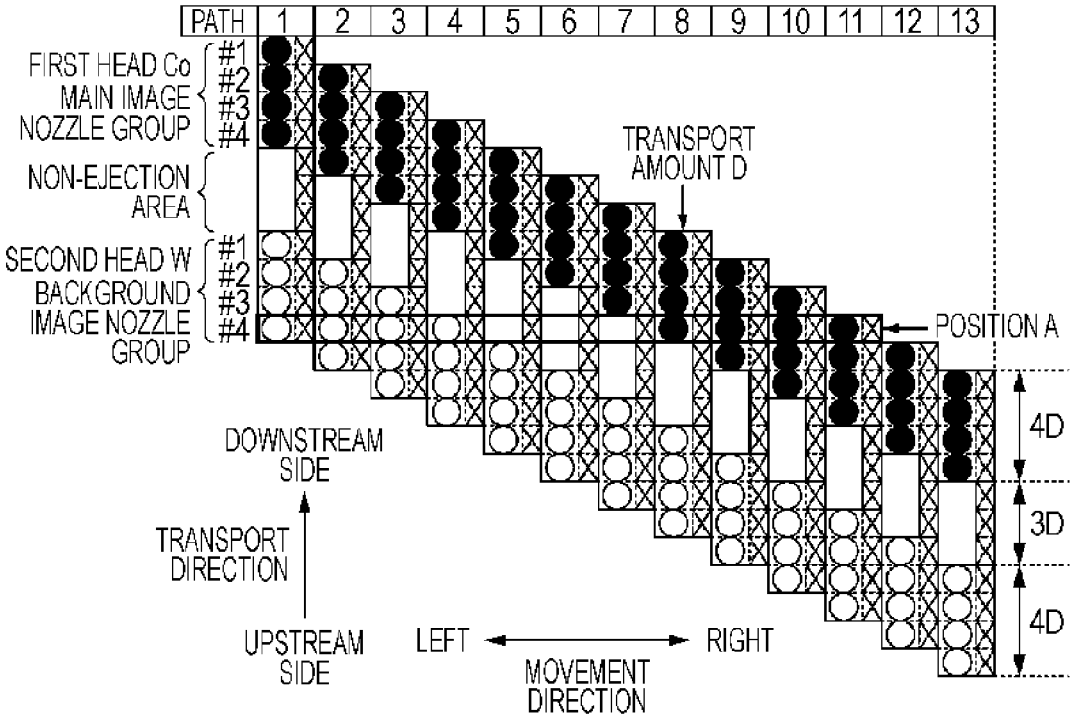
FIGS. 7A and 7B are diagram which describe a printing method of a second embodiment.
Figure 7B:
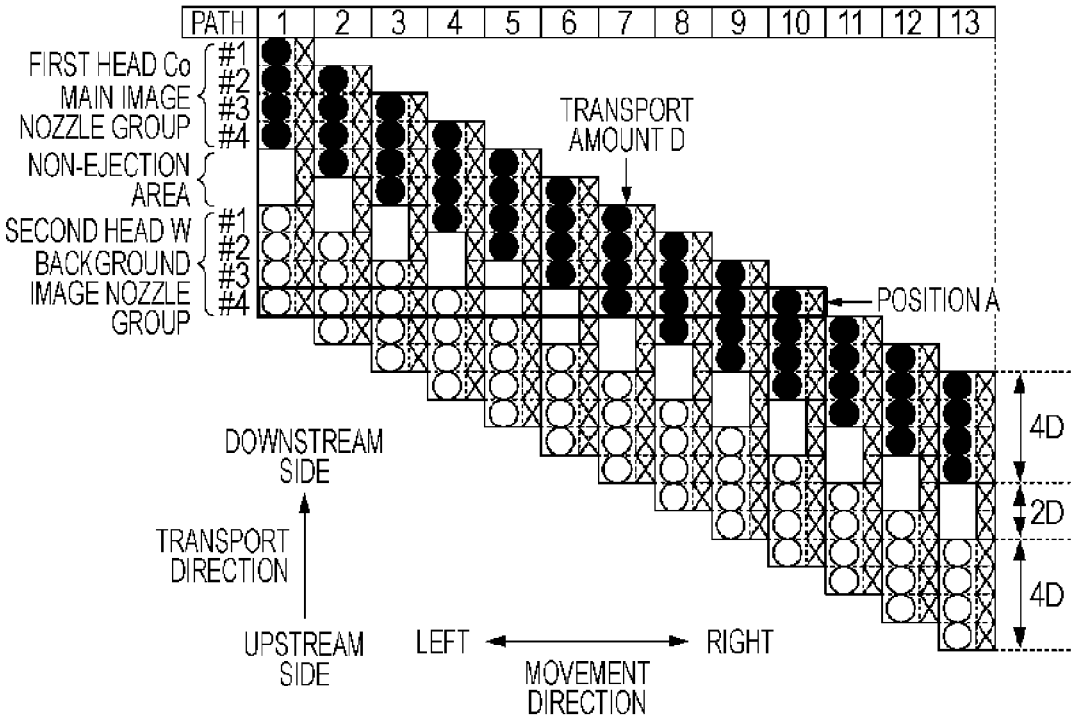

FIGS. 7A and 7B are diagrams which describe a printing method of a second embodiment. In the figure, a front side printing mode is exemplified to be described. An irradiation amount of UV light to be radiated to an underlying image between the end of printing of the underlying image with respect to a predetermined region of a medium and the start of overlapping printing of the upper image varies (irradiation amount of UV light to be radiated to the underlying image varies) according to properties of UV ink, a desired image quality of an image, a curing degree of the underlying image necessary before overlapping the upper image, or the like.

Therefore, in the second embodiment, a controller 10 adjusts a head interval between a first head 41 (1) and a second head 41 (2) so that the length of a non-ejection area in the transport direction becomes long when the irradiation amount of the UV light to be radiated to one image (underlying image) by the provisional irradiation units 51*a* and 51*b* during a time before the other image (upper image) is overlappingly formed on one image after previously forming the one image (underlying image) between a main image and a background image in a predetermined region of the medium is a second irradiation amount which is larger than a first irradiation amount, compared to when it is the first irradiation amount.

More specifically, when the irradiation amount of the UV light to be radiated to the underlying image is large, as shown in FIGS. 5A and 5B, the controller 10 adjusts the head interval so that the length of the non-ejection area in the transport direction becomes "4D" which is the same as that of nozzle group for image printing (main image nozzle group and background image nozzle group) in the transport direction. By doing that, a predetermined region of the medium faces the non-ejection area over the same number of passes (four passes) as the number of passes printing each image after printing the underlying image, accordingly, it is possible to radiate a large amount of UV light to the underlying image.

On the other hand, when the irradiation amount of the UV light to be radiated to the underlying image is small, as shown in FIG. 7A, the controller 10 adjusts the head interval so that the length of the non-ejection area in the transport direction becomes "3D" as ¾ of the length of the image printing nozzle group in the transport direction. By doing that, it is possible to make the irradiation amount of UV light to be radiated to the underlying image small, since the number of passes in which the predetermined region of the medium faces the non-ejection area after printing the underlying image becomes three passes. In addition, it is possible to reduce the printing time in a printing method in FIG. 7A, compared to the printing method in FIGS. 5A and 5B to an extent of the reduced number of passes in which a predetermined region of the medium faces the non-ejection area after printing the underlying image.

In addition, when the irradiation amount of the UV light to be radiated to the underlying image is smaller, as shown in FIG. 7B, the controller 10 adjusts the head interval so that the length of the non-ejection area in the transport direction become shorter (2D). By doing that, the number of passes in which the predetermined region of the medium faces the non-ejection area after printing the underlying image is further reduced, accordingly, it is possible to reduce the irradiation amount of the UV light to be radiated to the underlying image.

However, the length of the non-ejection area in the transport direction becomes the length of the integral multiplication of the medium transport amount in one transport operation. By doing that, it is possible to make the number of passes in which the underlying image faces the non-ejection area constant not depending on the position in the transport direction.

In this manner, in the second embodiment, the controller 10 adjusts the head interval so that the length of the non-ejection area in the transport direction varies according to the irradiation amount of the UV light to be radiated to the underlying image. By doing that, when the irradiation amount of the UV light to be radiated to the underlying image is large, it is possible to increase the number of passes in which the underlying image faces the non-ejection area, and to overlap the upper image in a state where the underlying image is reliably cured. On the other hand, when the irradiation amount of the UV light to be radiated to the underlying image is small, it is possible to reduce the number of passes in which the underlying image unnecessarily faces the non-ejection area, and to reduce the printing time. That is, it is possible to reduce the printing time while overlapping the upper image in a state where the underlying image is sufficiently cured.

Printing Method: Third Embodiment

In the overlap mode in which the main image and the background image are overlapped with each other, the longer the length of the non-ejection area in the transport direction, the larger the number of passes in which a predetermined region of the medium faces the non-ejection area after printing the underlying image, and it is possible to increase the irradiation amount of the UV light to be radiated to the underlying image before the upper image is overlapped. However, the printing time becomes long.

Therefore, in the third embodiment, for example, when making the length of the non-ejection area short in order to make the printing time short, an irradiation intensity of the UV light from the provisional irradiation units 51*a* and 51*b* is set to be strong. That is, when the length of the non-ejection area in the transport direction is the second length which is shorter than the first length compared to the first length, the irradiation intensity ($mW/cm^2$) of the UV light from the provisional irradiation units 51*a* and 51*b* is set to be strong.

By doing that, it is possible to increase the irradiation amount of the UV light (irradiation intensity of UV ligh× irradiation time) to be radiated to the underlying image before the upper image is overlapped, even when the length of the non-ejection area in the transport direction is set to be short. Accordingly, it is possible to make the printing time short while overlapping the upper image in a state where the underlying image is sufficiently cured.

In addition, for example, in order to make the irradiation intensity of the UV light from the provisional irradiation units 51*a* and 51*b* strong, a large current may be applied to the provisional irradiation units 51*a* and 51*b*. In addition, the irradiation intensity of the provisional irradiation units 51*a* and 51*b* in the entire region may be strengthened, and the irradiation intensity of the provisional irradiation units 51*a* and 51*b* only at a portion aligning with the non-ejection region in the movement direction may be strengthened.

Figure 8:
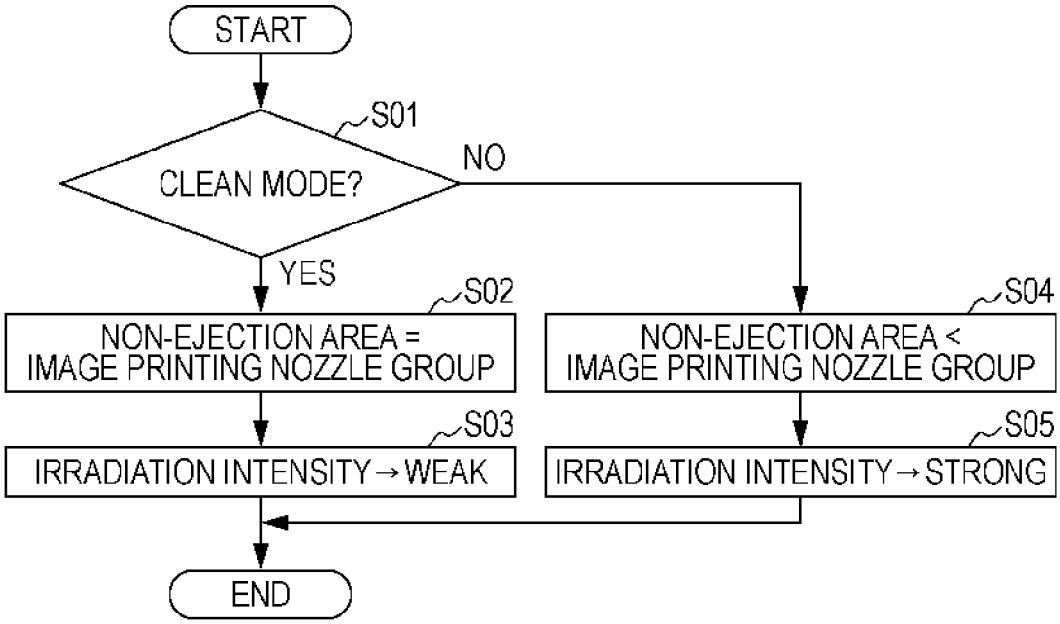
FIG. 8 is an example of a flow which determines the length of a non-ejection area in the transport direction.

FIG. 8 is an example of a flow which determines the length of the non-ejection area in the transport direction. Even when the irradiation intensity of the UV light from the provisional irradiation units 51*a* and 51*b* is set to be strong, instead of making the length of the non-ejection area short in the transport direction, it is possible to reliably cure the underlying image before the upper image is overlapped when the length of the non-ejection area in the transport direction is long.

Therefore, for example, when it is the overlap mode in which the main image and the background image are overlapped with each other, and a "clear mode" is set by a user (S01→Y), the controller 10 adjusts the head interval (S02) so that the length of the non-ejection area in the transport direction is set to be equal to the length of the image printing nozzle group (main image nozzle group and background image nozzle group) in the transport direction (FIGS. 5A and 5B).

On the other hand, when a "fast mode" is set by a user (S01→N), the controller 10 sets so that a printing method (FIGS. 7A and 7B) is to be executed, in which the length of the non-ejection area in the transport direction is shorter than that of the image printing nozzle group in the transport direction (S04).

In addition, when it is the clear mode, the controller 10 sets the irradiation intensity of the UV light from the provisional irradiation units 51*a* and 51*b* to be weak compared to a case where it is the fast mode (S03), and on the contrary, when it is the fast mode, sets the irradiation intensity of the UV light from the provisional irradiation units 51*a* and 51*b* to be strong, compared to a case where it is the clear mode (S05).

By doing that, when it is the clear mode, it is possible to increase the number of passes in which the underlying image faces the non-ejection area before being overlapped with the upper image, to overlap the upper image in a state where the underlying image is reliably cured, and to suppress a deterioration of the image quality of a printed image. On the other hand, when it is the fast mode, it is possible to prevent the upper image from being overlapped with the underlying image in a state where the underlying image is not sufficiently cured, and to reduce the printing time, since the irradiation intensity of the UV light from the provisional irradiation units 51*a* and 51*b* becomes strong.

In addition, the determination of the length of the irradiation nozzle group in the transport direction is not limited only by the printing mode. Since it is easy to express the glossiness on an image when the UV light is radiated for a long time with a relatively low irradiation intensity, for example, when it is desired to express the glossiness on the image, the length of the non-ejection area in the transport direction may be set to be long, and when it is not desired to express the glossiness on the image, the length of the non-ejection area in the transport direction may be set to be short. That is, the length of the non-ejection area in the transport direction may be determined according to the desired image quality.

MODIFICATION EXAMPLES

Modification Example 1

In the above described embodiment, UV-curable ink (photo-curable ink) which is cured by being irradiated with the UV light has been exemplified, however, it is not limited to this, and for example, it may be water-based ink, or organic solvent-based ink which penetrates the medium. When the main image and the background image are overlappingly printed using the ink, there is no problem that the upper image is overlapped in a state where the underlying image is insufficiently cured. However, as shown in FIGS. 4A and 4B, when positions of the head 41 (1) and 41 (2) are fixed in a state where the non-ejection area is not provided between the nozzle column of the first head 41 (1) and the nozzle column of the second head 41 (2), as shown in FIG. 6, the upper image is overlapped with the underlying image in a state of not being sufficiently dried in the subsequent pass of a pass in which the printing of the underlying image is completed. That is, the image quality is deteriorated since drying time of the underlying image is short, and the image is blurred, or colors thereof are blended.

Therefore, even when water-based ink, or the like is used, as shown in FIG. 5A, when the main image and the background image are overlapped with each other, the controller 10 may adjust the head interval so that the non-ejection area is provided between the nozzle column of the first head 41 (1) and the nozzle column of the second head (2) in the transport direction. By doing that, it is possible to dry the underlying image during a time in which the underlying image faces the non-ejection area, to overlap the upper image in a state where the underlying image is sufficiently dried, and to suppress the deterioration of the image quality by suppressing a blurry image, or color blending of the image.

Modification Example 2

In the above described embodiment, when the main image and the background image are overlapped with each other, as shown in FIG. 5A, the non-ejection area is provided between the nozzle column of the first head 41 (1) and the nozzle column of the second head 41 (2), however, it is not limited to this. For example, the controller 10 may adjust the head interval so that the non-ejection area is not provided between the nozzle column of the first head 41 (1) and the nozzle column of the second head 41 (2) (FIG. 4A), even when the main image and the background image are overlapped with each other, when the irradiation amount of the UV light to be radiated to the underlying image before the upper image is overlapped is small, or when it is desired to make the printing time short.

That is, it is possible to adjust the time until before the upper image is overlappingly formed after forming the underlying image with respect to a predetermined region of the medium, and to prevent the printing time from becoming unnecessarily long while overlapping the upper image in a state where the underlying image is sufficiently cured and dried by adjusting the head interval.

Modification Example 3

In the above described embodiment, in order to execute both the front side printing mode and the rear side printing mode, the nozzle column (YMCK) for printing the main image and the nozzle column (W) for printing the background image are provided (FIG. 2) even in both the first head 41 (1) and the second head 41 (2), however, it is not limited to this, and any one of the modes can be executed.

For example, when it is a printer which executes only the front side printing mode, it is possible to provide only the nozzle column (YMCK) for printing the main image in the first head 41 (1) on the downstream side in the transport direction, and to provide only the nozzle column (W) for printing the background image in the second head 41 (2) on the upstream side in the transport direction.

In addition, in the above described embodiment, both the single mode in which only the main image is printed and the overlap mode in which the main image and the background image are overlapped with each other are executed, however, it is not limited to this, and only the overlap mode can be executed.

In addition, in the above described embodiment, two types of images of the main image and the background image are overlapped with each other, however, it is not limited to this. For example, three types of images (main image, background image, and coating image) may be overlapped with each other. In this case, when three types of images are overlapped with one another by providing three heads 41 in the carriage 31, and making the head interval of each head 41 variable, the controller 10 may adjust the head interval. By doing that, it is possible to overlap the center image in a state where the underlying image is sufficiently cured and dried and to overlap the upper image in a state where the center image is sufficiently cured and dried.

Modification Example 4

In the above described embodiment, each raster line configuring the main image and the background image is respectively printed in a plurality of passes including the transport operation therebetween, however, it is not limited to this. For example, each raster line configuring the main image and the background image may be printed in one pass, respectively. That is, a printing method in which a printing method (a so-called band printing) in which an image printed in one pass is aligned in the transport direction, and a raster line in other pass is not printed between raster lines which are printed in certain passes may be performed.

When the band printing is executed in a state where the non-ejection area is not provided between the nozzle column of the first head 41 (1) and the nozzle column of the second head 41 (2), the underlying image is printed in a predetermined region of the medium in a certain pass, and then the upper image is overlapped in the subsequent pass. When doing that, there is a concern that the upper image is overlapped in a state where the underlying image is not sufficiently cured or dried. Accordingly, even when the main image and the background image are overlappingly printed in the band printing, the controller 10 may adjust the head interval.

Modification Example 5

In the above described embodiment, the background image is printed only with white ink, however, it is not limited to this. Since a color tone of a white color is different depending on the type of white ink, the color of the white ink as is becomes the color of the background image when performing printing only with the white ink. In addition, there may be a case where a background image with a slight chromatic color is desired, not the pure white color. Therefore, it is preferable to print a background image with a desired white color (background image with an adjusted white color), by appropriately using a small amount of ink of four colors (YMCK) along with the white ink. In addition, on the contrary, it is preferable to remove the slight color in the white ink by mixing ink of four colors in the white ink.

In addition, the color of the background image is not limited to white, and it is possible to print the background image with color ink other than the white ink (for example, metallic ink). Further, printing of the main image is not limited to the ink of four colors (YMCK), and the main image may be printed by mixing the white ink to the ink of four colors.

Other Embodiments

In the above described embodiment, mainly the image forming device has been described, however, a disclosure of the method of image forming, or the like is included. In addition, the above described embodiment is to facilitate the understanding of the invention, and is not construed by limiting the invention. The invention may be changed and modified without departing from the scope of the invention, and it goes without saying that the equivalents thereof are included in the invention as a matter of course.

Regarding UV Ink

In the above described embodiment, as the photo-curable ink, the UV-curable ink has been exemplified, however, it is not limited to this. For example, it may be ink which is cured when being irradiated to visible light, and in this case, the light irradiation unit is assumed to radiate the visible light.

Regarding Printer

In the above described embodiment, a printer has been exemplified in which the ejection operation which ejects ink from the head while moving in the movement direction, and the transport operation which transports the medium in the transport direction are repeated, however, it is not limited to this. For example, it may be a printer in which an image is formed by repeating an operation of forming the image while moving the head in the medium transport direction with respect to continuous-feed paper which is transported in a printing region, and an operation of moving the head in the paper width direction, and transports a portion of the medium which is not printed yet to the printing region, thereafter.

Regarding White Color

The "color white" in the specification includes colors which are referred to as a white in general societal terms, as a so-called "whitish color", without being limited to white in the strict sense as the surface color of an object which reflects all of wavelengths of the visible light, 100%. The "color white" is a color of which the marking in Lab system is a circumference of radius 20 on the a*b* plane, and the inside thereof, and is color which is in a hue range expressed when L* is 70 or more, for example, when (1) color measurement mode using the Eye-One Pro made by SDG K. K. is spot colorimetry, light source is D50, backing is Black, and color of the printing medium is measured using a transparent film, color of which marking in the Lab system is a circumference of radius 20 on the a*b* plane, and is inside thereof, and is a color which is in the hue range expressed when L* is 70 or more, when (2) measurement mode using the colorimeter CM 2022 made by Minolta Co., Ltd. is D502° of a field of vision, and SCF mode, and the color thereof is measured using a white background color, a marking in Lab system is on the circumferential of radius 20 and inside thereof on an a*b* plane, and is in a range of color hue, or (3) the color of ink used as a background of an image as described in JP-A-2004-306591, and it is not limited to pure white as long as it is used as the background.

What is claimed is:

1. An image forming device comprising:

(A) a first head in which a first nozzle column in which nozzles ejecting first ink are aligned in a predetermined direction is provided;

(B) a second head in which a second nozzle column in which nozzles ejecting second ink are aligned in a predetermined direction is provided, and is located on one side of the first head in the predetermined direction;

(C) a movement mechanism which moves relative positions of the first head and the second head in the predetermined direction; and (D) a control unit which causes repeated execution of an ejection operation in which ink is ejected from the nozzle while causing the heads to move in the movement direction intersecting the predetermined direction, and a transport operation in which the head and the medium are relatively moved in the predetermined direction, wherein the control unit adjusts a head interval as an interval of the first head and the second head in the predetermined direction by the movement mechanism when the main image using the first ink and the background image using the second ink are overlappingly formed, wherein the control unit adjusts the head interval so that a non-ejection area in which the ink is not ejected between the first nozzle column and the second nozzle column in the predetermined direction is provided, when the main image and the background image are overlappingly formed.

2. The image forming device according to claim 1, wherein the control unit adjusts the head interval so that the length of the non-ejection area in the predetermined direction becomes the length of the integral multiple of an amount of relative movement of the head and the medium in the predetermined direction in the transport operation.

3. The image forming device according to claim 1, wherein the first ink and the second ink are photo-curable ink cured by being irradiated with light, wherein a light irradiation unit is further included which irradiates the photo-curable ink with light, and is arranged by being extended at least in the predetermined direction by stretching to an end portion of the one side of the second nozzle column in the predetermined direction from an end portion of the other side of the first nozzle column in the predetermined direction, wherein, in the ejection operation, the light irradiation unit and the head, and the medium relatively move in the movement direction; and wherein the control unit adjusts the head interval so that the length of the non-ejection area in the predetermined direction is set to be long when an irradiation amount of light to be radiated to one image during a time until the other image is overlappingly formed on one image after forming the one image in advance between the main image and the background image in a predetermined region of the medium by the light irradiation unit is a second irradiation amount which is larger than a first irradiation amount, compared to a case of the first irradiation amount.

4. The image forming device according to claim 1, wherein the first ink and the second ink are photo-curable ink cured by being irradiated with light, wherein the light irradiation unit is further included which irradiates the photo-curable ink with the light, and is arranged by being extended at least in the predetermined direction by stretching to an end portion of the one side of the second nozzle column in the predetermined direction from an end portion of the other side of the first nozzle column in the predetermined direction;

wherein in the ejection operation, the light irradiation unit and the head, and the medium relatively move in the movement direction, and wherein, when the length of the non-ejection area in the predetermined direction is the second length which is shorter than the first length, compared to a case of the first length, the irradiation intensity of the light from the light irradiation unit is strong.

5. The image forming device according to claim 1, wherein a third nozzle row in which nozzles ejecting the first ink are aligned in the predetermined direction is provided at the second head, and wherein, when the background image is not formed on the main image overlappingly, the control unit adjusts the head interval so as not to provide a non-ejection area where ink is not ejected between the first nozzle column and the third nozzle column.

6. The image forming device according to claim 1, wherein dot columns which configure the main image, and are formed along the movement direction are formed by the plurality of ejection movements including the transport operation therebetween, and wherein dot columns which configure the background image, and are formed along the movement direction are formed by the plurality of ejection movements including the transport operation therebetween.

7. A method of image forming comprising:

forming an image on a medium using (E) an image forming device, the device includes, (A) a first head in which a first nozzle column in which nozzles ejecting first ink are aligned in a predetermined direction is provided;

(B) a second head in which a second nozzle column in which nozzles ejecting second ink are aligned in a predetermined direction is provided, and is located on one side of the first head in the predetermined direction;

(C) a movement mechanism which moves a relative position of the first head and the second head in the predetermined direction; and (D) a control unit which causes repeated execution of an ejection operation in which ink is ejected from the nozzle while causing the heads to move in the movement direction intersecting the predetermined direction, and a transport operation in which the head and the medium are relatively moved in the predetermined direction, wherein the control unit adjusts a head interval as an interval of the first head and the second head in the predetermined direction by the movement mechanism when the main image using the first ink and the background image using the second ink are overlappingly formed, wherein the control unit adjusts the head interval so that a non-ejection area in which the ink is not ejected between the first nozzle column and the second nozzle column in the predetermined direction is provided, when the main image and the background image are overlappingly formed.

8. An image forming device comprising:

(A) a first head in which a first nozzle column in which nozzles ejecting first ink are aligned in a predetermined direction is provided;

(B) a second head in which a second nozzle column in which nozzles ejecting second ink are aligned in a predetermined direction is provided, and is located on one side of the first head in the predetermined direction;

(C) a movement mechanism which moves relative positions of the first head and the second head in the predetermined direction; and (D) a control unit which causes repeated execution of an ejection operation in which ink is ejected from the nozzle while causing the heads to move in the movement direction intersecting the predetermined direction, and a transport operation in which the head and the medium are relatively moved in the predetermined direction, wherein the control unit adjusts a head interval as an interval of the first head and the second head in the predetermined direction by the movement mechanism when the main image using the first ink and the background image using the second ink are overlappingly formed, wherein a third nozzle row in which nozzles ejecting the first ink are aligned in the predetermined direction is provided at the second head, and wherein, when the background image is not formed on the main image overlappingly, the control unit adjusts the head interval so as not to provide a non-ejection area where ink is not ejected between the first nozzle column and the third nozzle column.

* * * * *